United States Patent [19]

Hamrick et al.

[11] 4,053,015

[45] Oct. 11, 1977

[54] IGNITION PROCESS FOR DOWNHOLE GAS GENERATOR

[75] Inventors: Joseph T. Hamrick, Roanoke; Leslie C. Rose, Rocky Mount, both of Va.

[73] Assignee: World Energy Systems, Fort Worth, Tex.

[21] Appl. No.: 714,787

[22] Filed: Aug. 16, 1976

[51] Int. Cl.[2] ..... E21B 43/24

[52] U.S. Cl. ..... 166/302

[58] Field of Search ..... 166/302, 256, 260, 59, 166/300

[56] References Cited

U.S. PATENT DOCUMENTS

| | | | |
|---|---|---|---|
| 3,219,108 | 11/1965 | Monroe | 166/300 X |
| 3,313,745 | 4/1967 | Rees, Jr. | 166/59 |
| 3,713,482 | 1/1973 | Lichte, Jr. et al. | 166/59 |
| 3,746,088 | 7/1973 | Haskin et al. | 166/59 |
| 3,774,682 | 11/1973 | Bousaid et al. | 166/302 X |
| 3,780,803 | 12/1973 | Hardy et al. | 166/59 |
| 3,880,235 | 4/1975 | Berry et al. | 166/59 X |

*Primary Examiner*—Stephen J. Novosad

*Attorney, Agent, or Firm*—Wofford, Felsman, Fails & Zobal

[57] ABSTRACT

A process of igniting a downhole generator having a fuel conduit and an oxidizing fluid conduit extending from the surface to the generator for supplying a fuel and an oxidizer to its chamber. Coupled to the two conduits near the generator are two solenoid control valves which are controlled from the surface. In carrying out the process, the valves are closed and a slug of hypergolic fuel is injected into the fuel conduit and an oxidizing fluid injected into the oxidizing fluid conduit. A generator fuel is injected into the fuel conduit behind the hypergolic fuel. The two valves are opened to allow the hypergolic fuel and oxidizer to pass into the chamber to cause spontaneous ignition of the hypergolic fuel to ignite the generator fuel and an oxidizer which follow.

5 Claims, 1 Drawing Figure

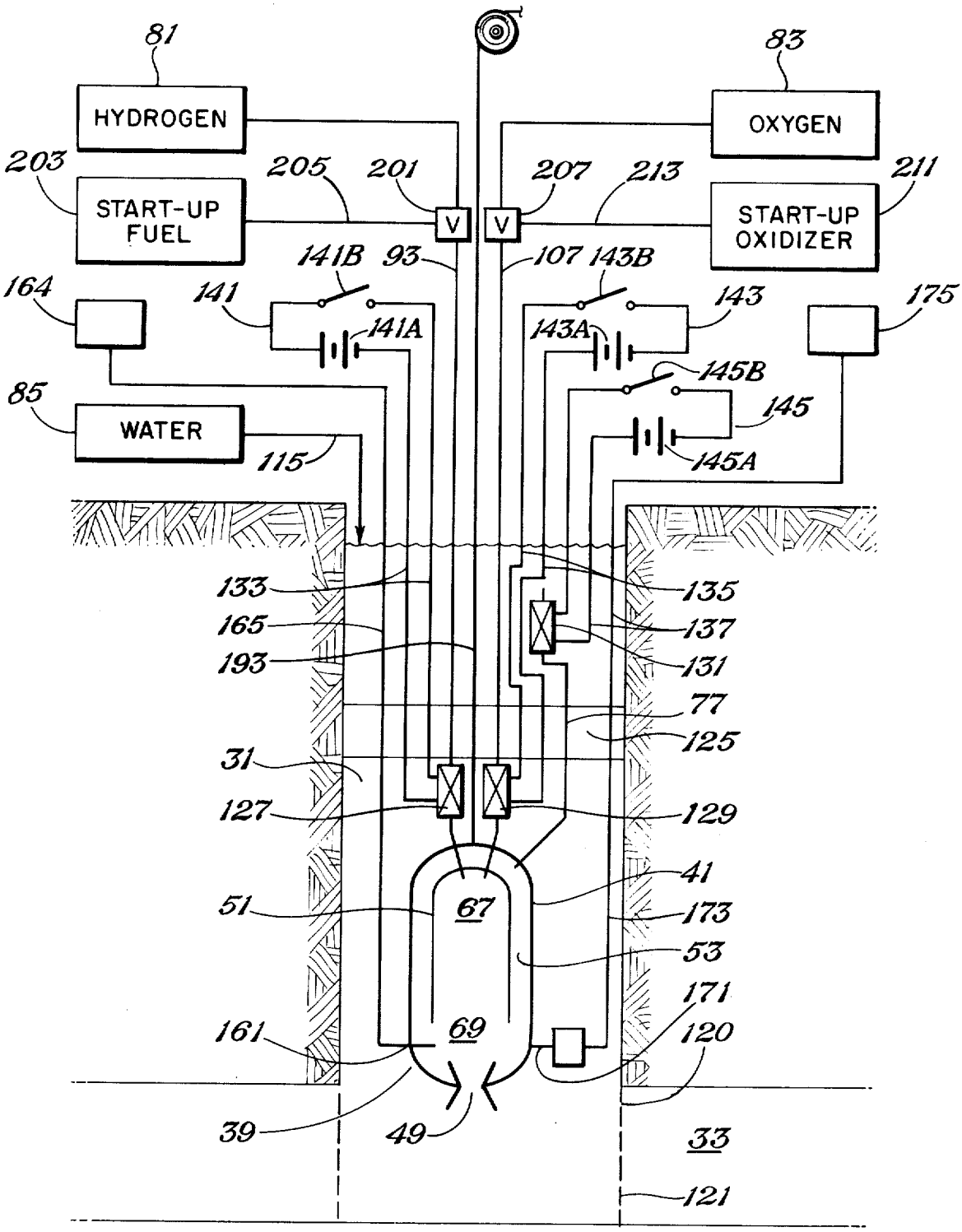
81
HYDROGEN
83
OXYGEN
203
START-UP FUEL
205
201
V
V
207
213
START-UP OXIDIZER
211
141B
93
107
143B
164
141
141A
143A
143
175
145B
85
WATER
145
115
145A
133
135
165
137
193
131
77
125
31
127
129
41
51
67
173
53
171
161
69
120
39
49
33
121

IGNITION PROCESS FOR DOWNHOLE GAS GENERATOR

BACKGROUND OF THE INVENTION

This invention relates to a process of igniting the fuel of a downhole generator with the use of a start-up fuel which ignites spontaneously upon contact with an oxidizer.

In U.S. patent application Ser. No. 534,778, filed Dec. 20, 1974, and now U.S. Pat. No. 3,982,591, there is described a downhole gas generator which in the embodiment disclosed, employs an electrical means using a glow plug or spark plug for igniting the generator fuel in its combustion chamber. Although such ignition devices are operable, they have disadvantages in that they require the use of electrical conductors to extend from the surface to the downhole generator. In addition, means must be provided for inserting a sealing the glow plug or spark plug in the generator. The glow plug or spark plug can be damaged by being continuously exposed to the combustion zone temperature and can allow a leakage path through the generator wall.

SUMMARY OF THE INVENTION

It is an object of the present invention to provide an ignition process and system for igniting the generator fuel in the combustion chamber of a downhole gas generator which avoids the above disadvantages.

It is a further object of the present invention to provide a process of igniting the fuel of a downhole gas generator with the use of a start-up fuel which ignites spontaneously upon contact with an oxidizer.

The downhole generator has a fuel conduit and an oxidizing fluid conduit extending from the surface to the generator for supplying a fuel and an oxidizer to its chamber. Coupled to the two conduits near the generator are two solenoid controlled valves which are remotely controlled from the surface. In carrying out the process, the valves are closed and a start-up fuel is injected into the fuel conduit and an oxidizing fluid injected into the oxidizing fluid conduit. A generator fuel in injected into the fuel conduit behind the start-up fuel. The two valves are opened to allow the start-up fuel and oxidizer to pass into the chamber to cause spontaneous ignition of the start-up fuel to ignite the generator fuel and an oxidizer which follow.

In the embodiment disclosed, the start-up fuel is a liquid fuel while the oxidizer for causing spontaneous ignition of the start-up fuel may be a liquid oxidizer or a gaseous oxidizer. In the preferred embodiment, the start-up fluid comprise a hypergolic combination of fuel and oxidizer.

BRIEF DESCRIPTION OF THE DRAWING

The drawing illustrates a gas generator located in a borehole and an uphole system for operating the gas generator.

DETAILED DESCRIPTION OF THE INVENTION

Referring now to the drawing, there is illustrated a cased injection borehole 31 which penetrates a subsurface oil bearing formation 33. Supported in the borehole 31 by a cable 193 is a gas generator 39 for producing hot gases to stimulate oil production for formation 33. The hot gases drive the oil in the formation 33 to other spaced boreholes (not shown) which penetrate formation 33, for recovery purposes in a manner well known to those skilled in the art. The gas generator 39 comprises a chamber formed by an outer shell 41 in which is supported an inner shell 51. A combustion zone 67 is defined at the upper end of the inner shell 51 and a mixing zone 69 is defined at the lower end of the inner shell 51. A restricted outlet 49 is formed through the lower end of the outer shell 41. In addition, a cooling annulus 53 is formed between the inner shell 51 and the outer shell 41 and which is in fluid communication with the mixing zone 69 and the outlet 49. The borehole is sealed above the outlet 59 by a packer 125 also supported by the cable 193. A detailed description of these components of the gas generator 39 may be found by reference to application Ser. No. 534,778, now U.S. Pat. No. 3,982,591.

In one embodiment, hydrogen and oxygen may be injected into the combustion zone 67 of the chamber to form a combustible mixture which is ignited and burned. The hydrogen and oxygen introduced into the combustion zone may be a stoichiometric mixture or a hydrogen-rich mixture. Water is supplied to the annulus 53 which cools the inner shell 51 and flows into the mixing zone 69 to cool the combustion gases to the desired temperature. The hot gases and steam derived from the combustion of hydrogen and oxygen and from the cooling water then flow through the outlet 49 into the formation 33 through apertures 120 formed through the casing 121.

Hydrogen is supplied to the gas generator from an uphole hydrogen supply 81 and a conduit 93 which extends from the supply 81 to the gas generator. Oxygen is supplied to the gas generator from an uphole oxygen supply 83 and conduit 107 which extends from the supply 83 to the gas generator. Solenoid controlled valves 127 and 129 are coupled to the conduits 93 and 107 near the gas generator 39 for controlling the flow of hydrogen and oxygen into the combustion zone of the gas generator chamber. Water is supplied to the borehole from a water supply 85 and a conduit 115. Water from the borehole is supplied to the annulus 53 by way of a conduit 77 which includes a solenoid controlled valve 131 located near the gas generator. One manner in which the valves 127, 129, and 131 may be supported near the gas generator 39 is described and shown in U.S. patent application Ser. No. 534,778, now U.S. Pat. No. 3,982,591.

Valves 127, 129 and 131 are remotely controlled by way of control systems 141, 143 and 145 located at the surface. System 141 comprses an electrical power source 141A and a switch 141B connected to the valve 127 by way of electrical leads 133; system 143 comprises an electrical power source 143A and a switch 143B connected to valve 129 by way of electrical leads 135; and system 145 comprises an electrical power source 145A and a switch 145B connected to valve 131 by way of leads 137. Valves 127, 129 and 131 may be normally closed valves which are opened by closing switches 141B, 143B and 145B respectively.

Connected in the conduit 93 is a three-way valve 201. A source 203 for providing a start-up fuel is connected to the valve 201 by way of conduit 205. A three-way valve 207 is connected in the conduit 107. A source 211 for providing an oxidizer for start-up purposes is connected to the valve 207 by way of conduit 213. The start-up fuel and oxidizer are of the type that when they are brought together, the start-up fuel ignites spontaneously. Preferably the start-up fuel is a liquid fuel. The oxidizer used for start-up purposes may be a liquid or a gas.

With all of the valves 127, 129, 131, 201 and 207 closed, the start-up sequence for the gas generator is as follows. Valve 201 is actuated to connect the source 203 with conduit 93 for flow of a slug of the start-up fuel by gravity downward to the closed valve 127. The flow of hydrogen from source 81 downward is blocked by the valve 201. Valve 207 also is actuated to connect the source 211 with conduit 107 for flow of the start-up oxidizing fluid downward to the closed valve 129. If the start-up oxidizing fluid is a liquid, it will flow downward by gravity. The flow of oxygen downward through conduit 107 is blocked by the valve 207. Next the valves 201 and 207 are actuated to terminate the flow of start-up fuel and oxidizing fluid from sources 203 and 211 respectively and to allow hydrogen and oxygen from sources 81 and 83 to flow downward into conduits 93 and 107 to pressurize these conduits with hydrogen and oxygen behind the slugs of start-up fuel and oxidizing fluid. Switches 141B and 143B then will be closed to open valves 127 and 129 to allow the slugs of start-up fuel and oxidizing fluid to flow into the combustion chamber 67 for mixture where the start-up fuel will ignite spontaneously and in turn ignite the hydrogen and oxygen will follow through conduits 93 and 107. Switch 145B next will be closed to open the valve 131 to allow water from the borehole to flow through conduit 77 into the annulus 53. A thermocouple 161 and a pressure transducer 171 are employed to determine if a proper ignition has been achieved and whether the desired temperature is being maintained. As shown, thermocouple 161 is coupled to an uphole read-out 164 by way of conductors illustrated at 165 while the pressure transducer 171 is coupled to an uphole read-out 175 by way of conductors illustrated at 173. For the time duration that the gas generator is operated to generate steam and hot gases, valves 127 and 129 will be maintained opened and valves 201 and 207 positioned to allow the flow of hydrogen and oxygen downhole from sources 81 and 83 by way of conduits 93 and 107. In addition, valve 131 will be maintained opened to allow water to flow into the annulus 53 by way of conduits 77.

In shut down operations, the valve 129 will be shut off followed by shut off of the valves 127 and 131.

In the preferred embodiment, the start-up fuel and start-up oxidizing fluid are hypergolic combinations of fuel and oxidizers as set forth below.

| FUEL | OXIDIZERS |
|---|---|
| aniline | $N_2O_4$ |
| | white fuming nitric acid |
| diethylenetriamine | red fuming nitric acid |
| ethylamine | $N_2O_4$ |
| furfuryl alcohol | white fuming nitric acid |
| hydrazine | $N_2O_4$ |
| | white fuming nitric acid |
| lithium borohydride | oxygen |
| methyl alcohol | chlorine trifluoride |
| triethyl aluminum | oxygen |
| triethyl borane | oxygen |
| turpentine (α-pinene) | red fuming nitric acid |
| unsymmetrical dimethyl hydrazine | 76% $N_2O_4$ & 24% NO |
| 2, 3 - xylidene | $N_2O_4$ |

For the combinations where oxygen is employed as an oxidizer for start-up purposes, the source 211 and conduit 213 will not be employed and the valve 207 will be actuated to allow flow of oxygen downward through conduit 107 to closed valve 129 prior to start-up. After valve 129 is opened for start-up purposes valve 207 will remain open to continue to supply oxygen to the combustion chamber 67 for mixture with the hydrogen for operating the gas generator.

As described in U.S. patent application Ser. No. 534,778, the hydrogen supply 81 may comprise a hydrogen supply tank, a hydrogen compressor, a metering valve, and a flow meter. Similarly the oxygen supply 83 may comprise an oxygen supply tank, an oxygen compressor, a metering valve, and a flow meter. The water supply 85 may comprise a water reservoir, a water treatment system, and a pump. The output of the thermocouple 161 may also be connected to an uphole hydrogen flow control which in turn is connected to the hydrogen metering valve for obtaining the proper hydrogen-oxygen ratio. Such a system will also include a comparitor coupled between the hydrogen and oxygen flow meters and to the oxygen metering valve for moving the oxygen metering valve in a direction that will maintain the hydrogen-oxygen ratio constant.

It is to be understood that fuels and oxydizers other than hydrogen and oxygen may be employed for flow into the combustion zone 67 for ignition and burning for operating the gas generator and in addition coolants other than water may be employed for flow into the annulus 53. Valves 127, 129 and 131 also may be of the type that can be controlled pneumatically or hydraulically by tubing which would communicate the pneumatic or hydraulic means from the surface to the valves.

We claim:

1. A process of operating a system for use for recovering hydrocarbons or other materials from underground formations penetrated by a borehole, said system including a gas generator located in the borehole, said gas generator comprising:

a housing forming a chamber and having an upper inlet end for receiving fuel and an oxidizing fluid, said chamber defining a combustion zone, and a restricted lower outlet for the passage of heated gases, said system comprising:

fuel conduit means extending from the surface to said inlet end for supplying fuel from the surface into said chamber, oxidizing fluid conduit means extending from the surface to said inlet end for supplying oxidizing fluid into said chamber, first valve means located in the borehole near said gas generator and coupled to said fuel conduit means, second valve means located in the borehole near said gas generator and coupled to said oxidizing fluid conduit means, and control means located at the surface for controlling said first and second valve means, said process comprising the steps of:

while said first valve means is closed injecting a given fuel into said fuel fuel conduit means for flow to the level of said first valve means, while said second valve means is closed injecting a given oxidizing fluid into said oxidizing fluid conduit means for flow to the level of said second valve means, said given fuel being characterized such that it ignites spontaneously when exposed to said given oxidizing fluid, injecting a second fuel into said fuel conduit means behind said given fuel, operating said control means to open said first and second valve means for allowing said given fuel and said given oxidizing fluid to flow into said chamber for ignition of said given fuel, and flowing said second fuel and an oxidizing fluid into said chamber to form a combustible mixture which is ignited by the ignition of said given fuel.

2. The process of claim 1 wherein:

said given fuel is a liquid fuel.

3. The process of claim 2 wherein said second fuel is different from said given fuel.

4. The process of claim 1 wherein:

said given fuel is a liquid fuel, said given oxidizing fluid is a liquid oxidizing fluid.

5. The process of claim 4 wherein:

said second fuel is different from said given fuel, said oxidizing fluid flowed into said chamber to form a combustible mixture with said second fuel is different from said given oxidizing fuel.

* * * * *